US012571216B1

(12) United States Patent
Olinger et al.

(10) Patent No.: US 12,571,216 B1
(45) Date of Patent: Mar. 10, 2026

(54) INTERLOCKING PANELS WITH V-SHAPED SEAMS

(71) Applicant: Westlake Royal Building Products (USA) Inc., Houston, TX (US)

(72) Inventors: Rodney Olinger, Saltville, VA (US); Andrew Fazekas, Ashburn, VA (US); Steven Mitchell, Chilihowie, VA (US); Brian Stafford, Bristol, VA (US)

(73) Assignee: WESTLAKE ROYAL BUILDING PRODUCTS (USA) INC., Houston, TX (US)

( * ) Notice: Subject to any disclaimer, the term of this patent is extended or adjusted under 35 U.S.C. 154(b) by 0 days.

(21) Appl. No.: 18/957,332

(22) Filed: Nov. 22, 2024

(51) Int. Cl.
*E04F 13/076* (2006.01)
*E04F 13/08* (2006.01)

(52) U.S. Cl.
CPC ..... *E04F 13/076* (2013.01); *E04F 13/0862* (2013.01); *E04F 2201/0529* (2013.01)

(58) Field of Classification Search
CPC ..... E04F 13/076; E04F 13/0862; E04F 2201/0529; F16B 5/0004; F16B 5/0008; F16B 5/00012; F16B 5/0016
USPC ..... 52/582.2, 588.1, 584.1, 589.1, 592.1
See application file for complete search history.

(56) References Cited

U.S. PATENT DOCUMENTS 1,841,759 A * 1/1932 Nolte ..... E02D 5/04 405/281
1,855,113 A * 4/1932 Nolte ..... E02D 5/08 405/14
2,128,740 A * 8/1938 Dougherty ..... E02D 5/08 405/281
2,332,812 A * 10/1943 Rieger ..... E02D 5/08 405/281
5,699,601 A * 12/1997 Gilliam ..... B25B 27/00 403/364
6,053,666 A * 4/2000 Irvine ..... E02D 5/02 405/281
D459,491 S * 6/2002 Benteftifa ..... D25/125
D480,157 S * 9/2003 Benteftifa ..... D25/125
7,008,142 B2 * 3/2006 Moreau ..... E02D 5/04 405/281
7,021,012 B2 * 4/2006 Zeng ..... E04F 15/06 52/592.1
7,415,801 B2 * 8/2008 Zeng ..... F24D 3/14 52/592.1
7,748,176 B2 * 7/2010 Harding ..... E04F 19/066 52/592.1
7,793,470 B1 * 9/2010 Mathiesen ..... E04F 15/10 52/177
8,261,504 B2 * 9/2012 Hakansson ..... B44C 5/0492 52/391
8,402,707 B2 3/2013 Mitchell et al.
8,596,000 B2 12/2013 Mitchell et al.
9,803,385 B2 * 10/2017 Wagner ..... E04F 15/02044
9,957,683 B2 * 5/2018 Dawson ..... E02D 5/28
11,377,856 B2 * 7/2022 Boucké ..... E04F 15/107
11,492,808 B2 * 11/2022 Shaw ..... E04F 13/18
(Continued)

*Primary Examiner* — Brian E Glessner
*Assistant Examiner* — Adam G Barlow
(74) *Attorney, Agent, or Firm* — Polsinelli PC

(57) ABSTRACT

A panel system includes a first elongated panel including a first slope and an integrally formed first interlock that couples to a second elongated panel via an integrally formed second interlock to form a V-shaped seam where the first slope meets a second slope of the second elongated panel.

20 Claims, 1 Drawing Sheet

(56) References Cited

U.S. PATENT DOCUMENTS

| | | | | |
|---|---|---|---|---|
| 11,732,486 | B2 * | 8/2023 | Zhang | B32B 37/0053 52/588.1 |
| 12,110,693 | B1 * | 10/2024 | Devos | E04F 15/082 |
| 12,123,204 | B2 * | 10/2024 | Fahle | E04F 13/0894 |
| 2005/0144878 | A1 * | 7/2005 | Grafenauer | E04F 15/04 52/578 |
| 2005/0235593 | A1 * | 10/2005 | Hecht | B44C 5/043 52/592.1 |
| 2005/0284058 | A1 * | 12/2005 | Zeng | E04F 15/105 52/302.1 |
| 2011/0173914 | A1 * | 7/2011 | Engstrom | E04F 15/02038 52/582.2 |
| 2015/0252573 | A1 * | 9/2015 | Devos | E04C 2/38 52/582.2 |
| 2021/0310259 | A1 * | 10/2021 | Zhang | B32B 3/06 |
| 2024/0360679 | A1 * | 10/2024 | Prizzi | E04C 2/40 |

* cited by examiner

INTERLOCKING PANELS WITH V-SHAPED SEAMS

BACKGROUND

The present invention relates to panel systems, such as generally flat sections used in building, construction and other applications, including in walls, siding, flooring, soffits, ceilings, tiling, shelving, furniture and like. In non-limiting examples, a panel and system of interlocking siding panels provides a V-shaped seam where end portions of panels meet and join together.

The disclosures of U.S. Pat. No. 8,596,000 entitled "Interlocking Panel System", U.S. Design Pat. No. D779,684 entitled "Simulated Shake Panel," U.S. Pat. Pub. No. 2016/0017612 entitled "Siding Joinery with Fastener" are incorporated herein by reference in their entirety.

SUMMARY

A panel system in an example of the invention comprises a first elongated panel including a first slope and an integrally formed first interlock extending distally lengthwise beyond the first slope, a second elongated panel including a second slope and an integrally formed second interlock including a groove shaped to receive the first interlock, and the first interlock coupled to the second interlock to form a V-shaped seam where the first slope meets the second slope.

In examples, the V-shaped seam formed the first and second elongated panels is between a substantially flat outer surface of the first elongated panel and a substantially flat outer surface of the second elongated panel.

In a preferred example the first interlock is at an end of the first elongated board. In some examples the first interlock includes a projecting portion that provide the end of the first elongated board.

In some examples a projection portion of the first interlock couples to the groove of the second interlock beneath an outer surface of the second elongated panel. Preferably said outer surface is substantially flat, but will be appreciated as optionally also including designs, embossing, texture, printing, film coverings, coloring, grain features, and the like, in various examples.

A single interlocking panel in examples of the invention is configured to provide a V-shaped seam when coupled to identical interlocking panels to form a composite panel.

A first end portion of single interlocking panel includes a first end portion with a first slope and an integrally formed first interlock having a projection extending distally lengthwise beyond the first slope, a second end portion opposite the first end portion including a second slope and an integrally formed second interlock including a groove shaped to fit a shape that matches the projection of the first interlock; and an outer surface extending between the first slope and second slope.

Preferably the first slope and second slope extend diagonally in opposite directions so that when an identical interlocking panel is coupled together two slopes form a V-shaped seam.

In other examples, an interlocking panel couples to two identically shaped panels to provide two V-shaped seams. Preferably outer surface portions, such as flat outer surface portions that may include aesthetically desirable features, extend between each of the V-shaped seams.

DETAILED DESCRIPTION

Figure 1:
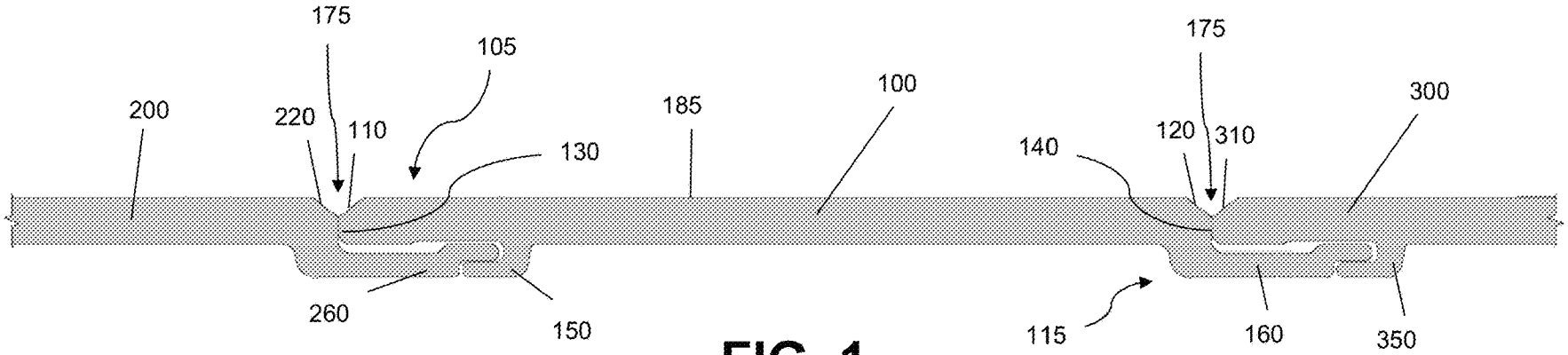
FIG. 1 is a cross-sectional lengthwise side plan view a siding panel joined between end portions of adjacent siding panels in one example.

The following description is intended to convey examples and details involving a siding panel assembly. It is understood, however, that the invention is not limited to these specific examples and details, which are exemplary only. It is further understood that one possessing ordinary skill in the art, in light of known devices, systems and methods, would appreciate the use of the invention for its intended purposes and benefits in any number of alternative examples.

Generally speaking, panel systems of the present invention are generally flat sections used in building, construction and other applications, including in walls, siding, flooring, ceiling, soffits, tiling, shelving, furniture and like. In one described but non-limiting example, a panel system of the invention includes siding panels that have a plurality of horizontally adjacent siding panels that are interlocked on their vertical ends to provide a composite siding panel. The siding panels are joined together so that the composite siding panels form a single unit, such as in a row with outer-facing surfaces of the siding panels providing an exterior siding surface of building in which a row of siding panels substantially forms a planar surface. These composite siding panels may be assembled in horizontal rows, adjacent other composite siding panels along respective horizontal edges of the adjacent rows, to form a siding panel assembly that covers a surface, such as the wall of a building. As used herein, the terms "horizontal" and "vertical" are not intended to be limited to a specific orientation and reflect generally perpendicular sides, edges or ends with respect to one another. The references of "horizontal" and "vertical" as describing one example of the invention are intended to continue to reference the respective edge, side or end in other examples where a panel or panel system is provided in another orientation relative to the ground or horizon. For example, in other examples, composite siding panels that are assembled from two or more panels may be oriented vertically rather than horizontally with respect to a building or wall, such that seams between panels (such V-shaped seams described herein) are provided horizontally across a building surface or wall when oriented vertically and be provided vertically across a building surface or wall when oriented horizontally. In still other examples panels may be joined in diagonal or other non-linear orientations with respect to a surface so that seams are provided in a desired pattern and directions.

In various examples, the panel assemblies and their components may be made from solid or foamed polymers, such as vinyl or cellular polyvinyl chloride (PVC). However, the examples are not so limited. The panel assemblies and their components may be made from any known or later-developed material used for siding and building panels including, but not limited to, wood, aluminum, steel and other metals, polymer materials, plastics, masonry, stone, brick, concrete, composites and combinations thereof. Panels of various materials may be shaped by extrusion, milling, molding, and the like. One having ordinary skill in the art would understand how to apply the teachings of various materials and panel manufacturing methods to various examples of the invention.

Figure 2:
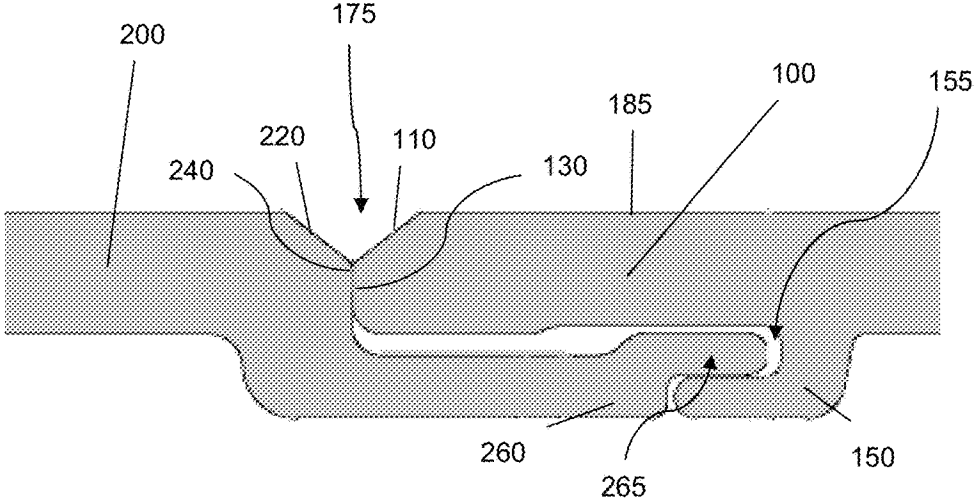
FIG. 2 is a partial magnified cross-sectional lengthwise side plan view of two adjacent end portions of siding panels joined together by complementary interlocks and forming a V-shaped seam in one example.

Referring to FIGS. 1 and 2, an example of an individual interlocking siding panel 100 is generally elongated and planar and substantially flat. The siding panel 100 includes a first end portion 105 with first slope portion 110 adjacent to a first flat edge 130. An integrally formed first interlock 150 having a groove 155 preferably underlies an outer surface 185 that extends between the first slope portion 110 and a second slope portion 120 at second end portion 115 opposite the first end portion 105. The second slope 120 preferably slopes diagonally in an opposite direction than the first slope 110. The second slope 120 is also adjacent a second flat edge 140 that is opposite the first flat edge 130. At said second end portion 115, a second interlock 160 extends distally lengthwise beyond the second slope 120. Preferably the groove 155 of the first interlock 150 is configured to mate with an interlock identical to a projection 165 of the second interlock 160 so that boards identical in shape to 100 can mate end portions together. It will be appreciated that "identical" is not intended to require perfect replication in form, but includes substantially the same shapes that complement one another to fit together as reasonably would be expected by one having ordinary skill in the relevant art, and that identical components or shapes might have immaterial differences or slight imperfections that do not materially interfere with the interlocking functions.

In this regard, a second interlocking panel 200 and third interlocking panel 300 are shown in FIG. 1 as including the same elements as panel 100. The first panel 100 couples to both the second panel 200 and third panel 300 to form a composite panel of the plurality of interlocked panels. A second interlock 260 of panel 200 couples to the first interlock of panel 100 with the projection 265 mating into groove 155. A second slope 220 of panel 200 forms a V-shaped seam 175 with the first slope of panel 100 when the first and second panels are coupled together with the second flat edge 240 of panel 200 abutting the first flat edge 130 of panel 100.

Similarly, the third panel 300 couples to the first panel 100 when the first interlock 350 of panel 300 received the second interlock 160 of panel 100 so that the second slope 120 of panel 100 forms a V-shaped seam with the first slope 310 of panel 300.

While various preferred examples have been described with reference to the accompanying drawings, it will be evident that various modifications and changes may be made thereto, and additional examples may be implemented, without departing from the broader scope of the invention as set forth in the claims that follow. The specification and drawings are accordingly to be regarded in an illustrative rather than restrictive sense.

What is claimed is:

1. A panel system comprising:

a first elongated panel including a first surface on a first plane and an opposite second surface on a second plane that is a first distance from the first plane, a first slope adjacent the first surface, and an integrally formed first interlock including a groove shaped to receive a second interlock, wherein the first interlock extends lengthwise adjacent the second surface toward the second interlock without extending beyond the second slope, and wherein the first interlock is a second distance from the first plane, and wherein the second distance is greater than the first distance;

a second elongated panel including a third surface on a third plane and an opposite fourth surface on a fourth plane that is a third distance from the third plane, a second slope adjacent the third surface, and the integrally formed second interlock extending distally lengthwise beyond the second slope, wherein the second interlock is a fourth distance from the third plane, and wherein the fourth distance is greater than the third distance;

and the first interlock coupled to the second interlock to form a V-shaped seam where the first slope meets the second slope.

2. The panel system of claim 1, wherein the V-shaped seam is between the first surface and the second surface.

3. The panel system of claim 2, wherein the first interlock is at an end of the first elongated panel.

4. The panel system of claim 1, wherein the first interlock is at an end of the first elongated panel.

5. The panel system of claim 4, wherein the second elongated panel ends at a projection portion of the second interlock.

6. The panel system of claim 5, wherein the projection portion of the second interlock extends from a bend of the second interlock.

7. The panel system of claim 1, wherein a projection portion of the second interlock extends from a bend of the second interlock.

8. The panel system of claim 2, wherein a projection portion of the second interlock extends from a bend of the second interlock.

9. The panel system of claim 3, wherein a projection portion of the second interlock extends from a bend of the second interlock.

10. The panel system of claim 4, wherein a projection portion of the second interlock extends from a bend of the second interlock.

11. A panel comprising:

a first end portion including a first slope and an integrally formed first interlock including a groove shaped to fit a shape that matches a projection of a second interlock;

a second end portion opposite the first end portion including a second slope and the integrally formed second interlock having a projection extending distally lengthwise beyond the second slope;

a first surface on a first plane extending between the first slope and second slope; and an opposite second surface on a second plane that is a first distance from the first plane and between the first interlock and the second interlock, wherein both the first interlock and second interlock are a greater distance from the first plane than the first distance and wherein the first interlock extends lengthwise adjacent the second surface without extending beyond the first slope in a direction away from the second end portion.

12. The interlocking panel of claim 11, wherein the first slope and second slope extend diagonally in opposite directions.

13. The interlocking panel of claim 12, wherein the projection of the second interlock extends from a bend of the second interlock.

14. The interlocking panel of claim 1, wherein the projection of the second interlock extends from a bend of the second interlock.

15. A composite panel including the interlocking panel of claim 11 as a first panel coupled to an identically shaped second panel and an identically shaped third panel.

16. A composite panel including the interlocking panel of claim 12 as a first panel coupled to an identically shaped second panel and an identically shaped third panel.

17. A composite panel including the interlocking panel of claim 13 as a first panel coupled to an identically shaped second panel and an identically shaped third panel.

18. A composite panel including the interlocking panel of claim 14 as a first panel coupled to an identically shaped second panel and an identically shaped third panel.

19. The composite panel of claim 15, wherein the first panel forms a V-shaped seam with the second panel and forms a V-shaped seam with the third panel.

20. The interlocking panel of claim 11, wherein the first slope is adjacent a first flat edge and the second slope is adjacent a second flat edge.

* * * * *